US009353454B2

(12) United States Patent
Shen et al.

(10) Patent No.: US 9,353,454 B2
(45) Date of Patent: May 31, 2016

(54) METHOD FOR ANODIZING AND DYEING METALLIC ARTICLE

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Li-Ming Shen, Shenzhen (CN); Kai-Bo Cao, Shenzhen (CN); Zhi-Yong Fan, Shenzhen (CN); Wei-Chao Li, Shenzhen (CN); Jia-Xiong Wang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 681 days.

(21) Appl. No.: 13/794,805

(22) Filed: Mar. 12, 2013

(65) Prior Publication Data

US 2013/0248372 A1 Sep. 26, 2013

(30) Foreign Application Priority Data

Mar. 22, 2012 (CN) ..... 201210077768

(51) Int. Cl.

| | |
|---|---|
| ***C25D 11/24*** | (2006.01) |
| ***C25D 11/02*** | (2006.01) |
| ***C25D 11/16*** | (2006.01) |
| ***C25D 11/26*** | (2006.01) |
| ***C25D 11/30*** | (2006.01) |

(52) U.S. Cl.

CPC ..... *C25D 11/246* (2013.01); *C25D 11/024* (2013.01); *C25D 11/16* (2013.01); *C25D 11/243* (2013.01); *C25D 11/26* (2013.01); *C25D 11/30* (2013.01)

(58) Field of Classification Search

CPC ..... C25D 11/18; C25D 11/246

See application file for complete search history.

(56) References Cited

U.S. PATENT DOCUMENTS

| | | | | | |
|---|---|---|---|---|---|
| 4,130,466 | A * | 12/1978 | Kramer | C09D 5/1643 | 205/201 |
| 4,756,771 | A * | 7/1988 | Brodalla | C25D 11/246 | 148/244 |
| 5,250,173 | A * | 10/1993 | Jozefowicz | C25D 11/22 | 205/121 |
| 5,820,740 | A * | 10/1998 | Le | B64G 1/226 | 205/171 |
| 2007/0028402 | A1* | 2/2007 | Matsuoka | C25D 11/24 | 8/685 |
| 2012/0015172 | A1* | 1/2012 | Gao | C25D 11/243 | 428/304.4 |
| 2013/0224406 | A1* | 8/2013 | Chang | H05K 13/0084 | 428/34.1 |
| 2013/0248373 | A1* | 9/2013 | Shen | C25D 11/26 | 205/120 |

* cited by examiner

*Primary Examiner* — Bryan D. Ripa

(74) *Attorney, Agent, or Firm* — Novak Druce Connolly Bove + Quigg LLP

(57) ABSTRACT

A method for anodizing and dyeing a metallic article including a decorated surface to be dyed, includes steps as follows: anodizing the metallic article to form an anodization layer on the decorated surface by an anodizing treatment, in which the anodization layer is porous with a number of holes; sealing the anodization layer of the metallic article anodized by a first sealing treatment in a first sealing solution, in which a contacting time of the anodization layer and the first sealing solution changes gradually along a predetermined direction, and thereby a depth of the holes of the anodization layer after sealing changes gradually along the predetermined direction; and coloring the metallic article sealed in a dyeing treatment.

18 Claims, 6 Drawing Sheets

METHOD FOR ANODIZING AND DYEING METALLIC ARTICLE

BACKGROUND

1. Technical Field

The present disclosure generally relates to methods for anodizing and dyeing metallic articles.

2. Description of Related Art

Metallic articles, such as articles made of aluminum/aluminum alloy, magnesium/magnesium alloy, and titanium/titanium alloy, are usually applied with an anodizing treatment, such that anodization layers are formed on the surfaces of the metallic articles to protect the metallic articles. To provide a color to the metallic articles to appear more colorful, after the anodizing treatment, the metallic articles may be applied with a dyeing treatment or a painting treatment. However, the color of the metallic article obtained may be in only one color, and also cannot produce a gradual color change or color gradient appearance.

Therefore, there is room for improvement within the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the present disclosure. Moreover, in the drawings like reference numerals designate corresponding parts throughout the several views. Wherever possible, the same reference numerals are used throughout the drawings to refer to the same or like elements of an embodiment.

DETAILED DESCRIPTION

Figure 1:
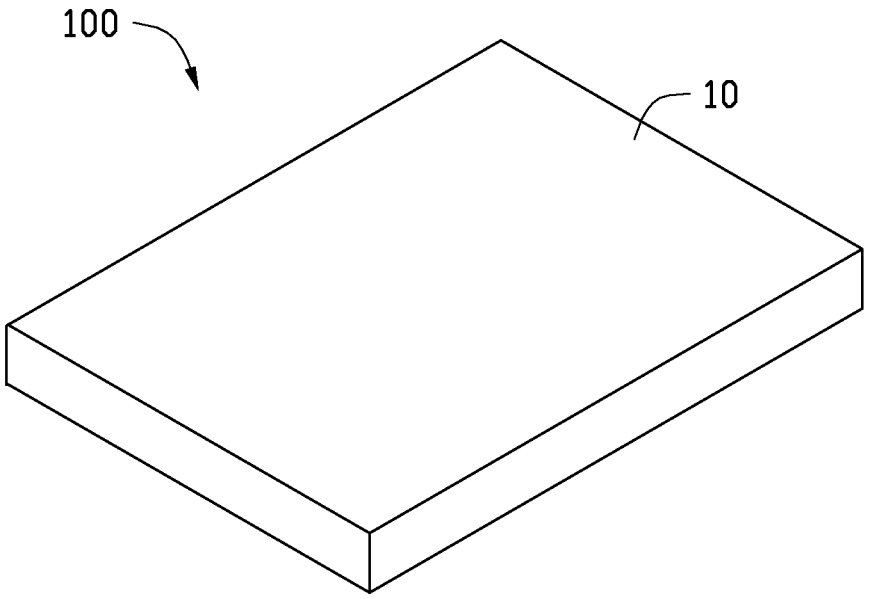
FIG. 1 shows an isometric view of a workpiece to be anodized and dyed of one embodiment.

FIG. 1 shows a workpiece 100 according to an illustrated embodiment to be anodized and dyed by a method for anodizing and dyeing a metallic article. The workpiece 100 is a metallic article made of aluminum alloy, and is substantially rectangular plate-like in shape. The workpiece 100 includes a decorated surface 10 to be dyed. In other embodiments, the workpiece 100 can be made of aluminum, magnesium, magnesium alloy, titanium, or titanium alloy.

Figure 6:
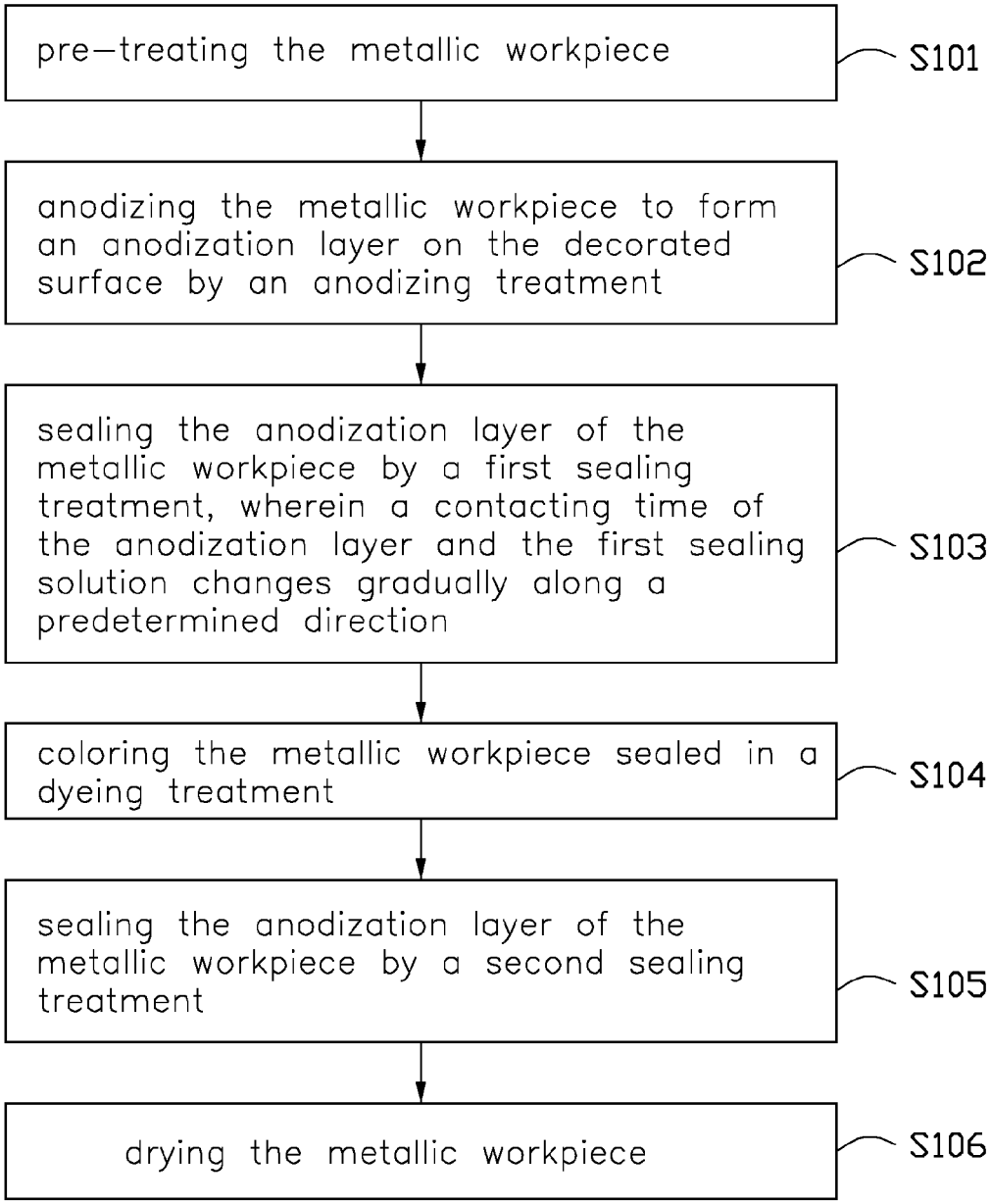
FIG. 6 is a flowchart showing an embodiment of a method for anodizing and dyeing the workpiece of FIG. 1.

Referring also to FIG. 6, an embodiment of a method for anodizing and dyeing the workpiece 100 of the illustrated embodiment of FIG. 1 is described as follows.

In step S101, the workpiece 100 is applied with one or more pre-anodizing treatments, for smoothing and texturing the decorated surface 10, and/or removing grease residues or a native oxide layer on the decorated surface 10. The one or more pre-anodizing treatments may include one or more of polishing, texturing, degreasing, alkaline etching, and desmutting. A degreasing solution used for performing degreasing of the grease residues is a weak alkaline solution, such as sodium pyrophosphate solution. An alkaline etching solution used for alkaline etching is a strong alkaline solution, such as a sodium hydroxide solution. A desmutting solution used for desmutting is a strong acid solution. Examples of polishing may include chemical polishing or mechanical polishing. Examples of texturing may include sandblasting or wiredrawing.

Figure 2:
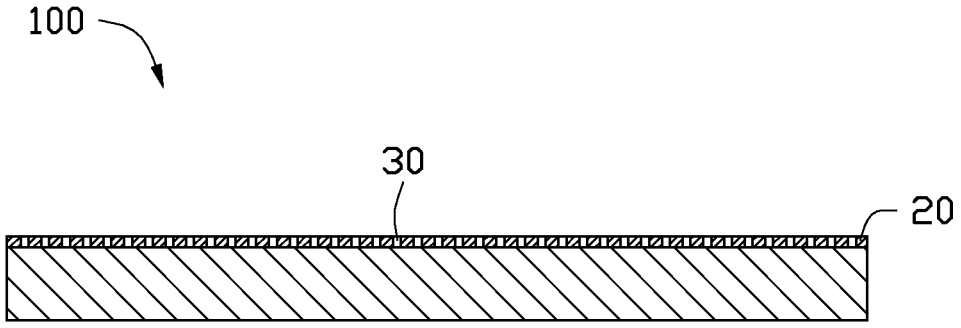
FIG. 2 shows a cross-sectional view of the workpiece of FIG. 1 after anodizing.

In step S102, the workpiece 100 is anodized by an anodizing treatment, such that an anodization layer 20 is formed on the decorated surface 10. The anodization layer 20 is porous having a plurality of holes 30 therein. The holes 30 have a substantially uniform depth (referring to FIG. 2). The anodizing treatment may be a direct current anodizing treatment, an alternating current anodizing treatment, or a pulse current anodizing treatment. In an illustrated embodiment, the direct current anodizing treatment is applied to the workpiece 100. The workpiece 100 as an anode is electrically connected with a positive electrode, and a sulfuric acid solution is used as an electrolyte solution, such that the anodization layer 20 is formed on the decorated layer 10. A thickness of the anodization layer 20 and a depth of the holes 30 can be changed by an anodization time, a current value, or a voltage value. In other embodiments, the electrolyte solution may include nitrate ion, phosphate ion, chromate ion, or silicateion.

Figure 3:
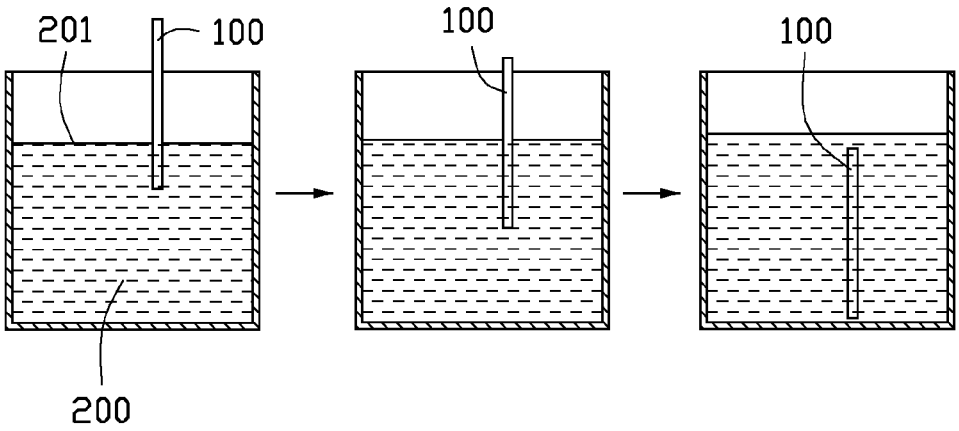
FIG. 3 shows a first sealing treatment for the workpiece of FIG. 1 after anodizing.
Figure 4:
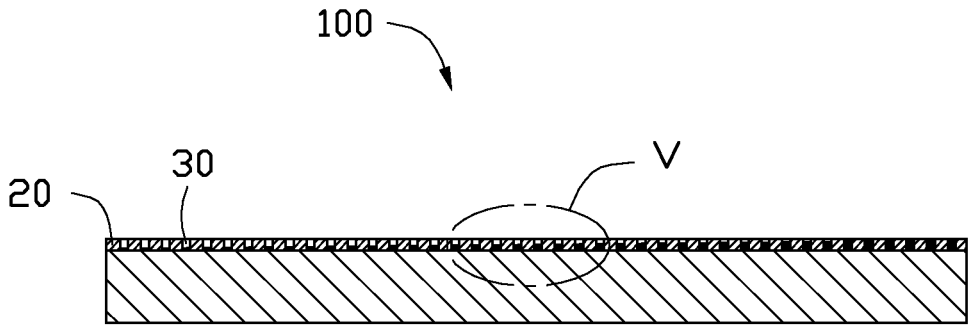
FIG. 4 shows a cross-sectional view of the workpiece of FIG. 1 after the first sealing treatment.
Figure 5:
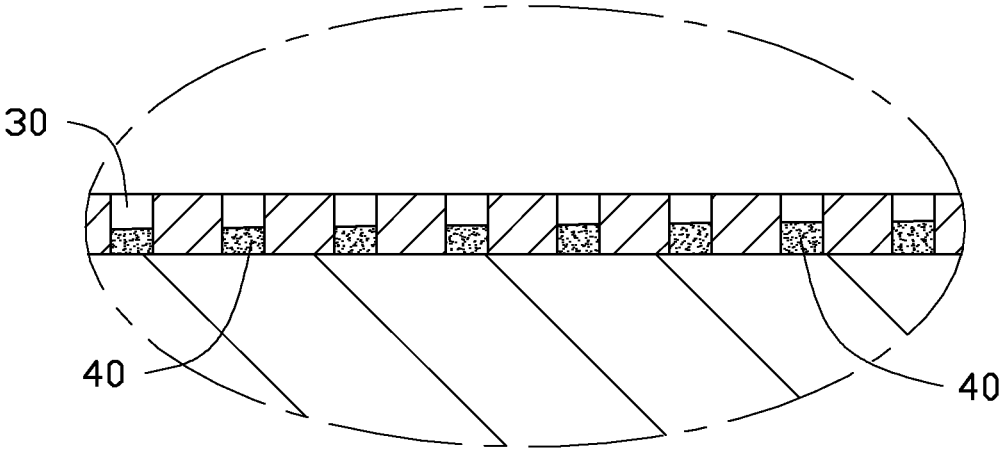
FIG. 5 shows an enlarged view of a circled portion V in FIG. 4.

In step S103, the workpiece 100 is sealed by a first sealing treatment in a first sealing solution 200. During the first sealing treatment, a contacting time (duration) of the anodization layer 20 and the first sealing solution 200 gradually changes along a predetermined direction, such that the depth of the holes 30 gradually changes along the predetermined direction after the first sealing treatment. In the illustrated embodiment, referring to FIGS. 3 through 5, the anodization layer 20 is configured substantially perpendicular to a liquid level 201 of the first sealing solution 200, and the workpiece 100 is immersed into the first sealing solution 200 at a predetermined velocity, and then taken out of the first sealing solution 200. The contacting time of the anodization layer 20 and the first sealing solution 200 gradually increases along a moving direction of the workpiece 100 during the first sealing treatment, and thereby an amount of a sealing agent 40 of the first sealing solution 200 entering into each of the holes 30 gradually increases along the moving direction of the workpiece 100 (referring to FIG. 5, a portion of the anodization layer 20 having larger amount of the sealing agent 40 enters into the first sealing solution 200 earlier than another portion of the anodization layer 20 having lesser amount of the sealing agent 40. Thus, the depth of the holes 30 gradually decreases along the moving direction of the workpiece 100. The sealing agents 40 of the first sealing solution 200 can be nickel acetate, nickel sulfate, or cobalt sulfate. The predetermined velocity of the workpiece 100 immersed into the first sealing solution 200 can be constant, or changing. When the predetermined velocity of immersion of the workpiece 100 is kept constant, the depth of the holes 30 decreases uniformly along the moving direction of the workpiece 100. If the predetermined velocity of immersion of the workpiece 100 changes, the depth of the holes 30 will decreases non-uniformly along the moving direction of the workpiece 100. In other embodiments, the contacting time of the anodization layer 20 and the first sealing solution 200 can change gradually along the predetermined direction in other ways. For example, the first sealing solution 200 is sprayed on the anodization layer 20 by a sprayer connected to the first sealing solution 200, and a spraying time is controlled along the predetermined direction.

In step S104, the workpiece 100 is colored by a dyeing treatment. In the dyeing treatment, a coloring agent enters into the holes 30 to dye the decorated layer 10. Because the depth of the holes 30 decreases gradually along the predetermined direction, an amount of the coloring agent entering into the holes 30 thereby decreases gradually along the predetermined direction. Thus, the anodization layer 20 is colored with a gradual changing color or color gradient.

In step S105, the workpiece 100 is sealed by a second sealing treatment in a second sealing solution (not shown). In the second sealing treatment, the workpiece 100 is immersed into the second sealing solution to seal the holes 30, such that the anodization layer 20 has a good wear resistance.

In step S106, the workpiece 100 is dried by heating.

In other embodiments, if the workpiece 100 is cleaned or a texturing effect is not needed, step S101 can be omitted. Step S105 can be omitted if a required wear resistance of the workpiece is low. Step S106 can be omitted if desired, and the workpiece can be air dried instead.

The contacting time of the anodization layer 20 and the first sealing solution 200 changes gradually along the predetermined direction, such that the depth of the holes 30 after the first sealing treatment changes gradually along the predetermined direction, and the amount of the coloring agent 40 entering into the holes 30 during the dyeing treatment thereby changes gradually along the predetermined direction. Thus, the anodization layer 20 after the dyeing treatment has a gradual changing color or color gradient. The above-described method for anodizing and dyeing a metallic article is easy to control, and thus is suitable for mass production.

Depending on the embodiment, some of the steps being described may be removed or eliminated, while other steps may be added, and the sequence of steps may be changed. It is also to be understood that the description and the claims drawn to a method may include some indication in reference to certain steps. However, the indication used is only to be viewed for identification purposes and not as a suggestion as to an order for the steps.

It is to be understood, however, that even through numerous characteristics and advantages of the disclosure have been set forth in the foregoing description, together with details of the structure and function of the present disclosure, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A method for anodizing and dyeing a metallic article, the metallic article comprises a decorated surface to be dyed, the method comprising steps as follows:

anodizing the metallic article to form an anodization layer on the decorated surface thereof by an anodizing treatment, wherein the anodization layer is porous having a plurality of holes therein;

sealing the anodization layer of the metallic article after the anodizing step by a first sealing treatment in a first sealing solution, wherein a contacting time of the anodization layer and the first sealing solution changes gradually along a predetermined direction, and a depth of the plurality of holes of the anodization layer after the sealing step thereby changes gradually along the predetermined direction; and coloring the metallic article sealed in a dyeing treatment.

2. The method for anodizing and dyeing a metallic article of claim 1, wherein in the step of sealing the anodization layer of the metallic article after the anodizing step by a first sealing treatment in a first sealing solution, the metallic article is immersed into the first sealing solution, and the anodization layer is configured substantially perpendicular to a liquid level of the first sealing solution, the contacting time of the anodization layer and the first sealing solution increases gradually along a moving direction of the metallic article, and the depths of the plurality of holes of the anodization layer after the sealing step decreases gradually along the moving direction of the metallic article.

3. The method for anodizing and dyeing a metallic article of claim 2, wherein a velocity of the metallic article immersing in the first sealing solution is constant.

4. The method for anodizing and dyeing a metallic article of claim 1, wherein in the step of sealing the anodization layer of the metallic article after the anodizing step by a first sealing treatment in a first sealing solution, the first sealing solution is sprayed on the anodization layer, and a spraying time is controlled along the predetermined direction, and the contacting time of the anodization layer and the first sealing solution changes along the predetermined direction.

5. The method for anodizing and dyeing a metallic article of claim 1, wherein the method further comprises a step of pre-treating the metallic article by a pre-anodizing treatment before the anodizing step.

6. The method for anodizing and dyeing a metallic article of claim 5, wherein the pre-anodizing treatment comprises a polishing, texturing, degreasing, alkaline etching, or desmutting.

7. The method for anodizing and dyeing a metallic article of claim 1, wherein the method further comprises a step of sealing the metallic article by a second sealing treatment after the step of coloring the metallic article to seal the plurality of holes after the metallic article has been dyed.

8. The method for anodizing and dyeing a metallic article of claim 1, wherein the metallic article is made of aluminum, aluminum alloy, magnesium, magnesium alloy, titanium, or titanium alloy.

9. The method for anodizing and dyeing a metallic article of claim 1, wherein the first sealing solution comprises nickel acetate, nickel sulfate, or cobalt sulfate.

10. The method for anodizing and dyeing a metallic article of claim 1, wherein the anodizing treatment comprises a direct current anodizing treatment, an alternating current anodizing treatment, or a pulse current anodizing treatment.

11. A method for anodizing and dyeing a metallic article, the metallic article is made of aluminum alloy and comprises a decorated surface to be dyed, the method comprising steps as follows:

anodizing the metallic article to form an anodization layer on the decorated surface by an anodizing treatment, wherein the anodization layer is porous with a plurality of holes therein;

sealing the anodization layer of the metallic article after the anodized step by a first sealing treatment in a first sealing solution, wherein the metallic article is immersed into the first sealing solution, and the anodization layer is configured substantially perpendicular to a liquid level of the first sealing solution, a contacting time of the anodization layer and the first sealing solution increase gradually along a moving direction of the metallic article, and a depth of the plurality of holes of the anodization layer thereby decrease gradually along the moving direction of the metallic article after the sealing step; and coloring the metallic article sealed in a dyeing treatment.

12. The method for anodizing and dyeing a metallic article of claim 11, wherein a velocity of the metallic article immersing in the first sealing solution is constant.

13. The method for anodizing and dyeing a metallic article of claim 11, wherein the method further comprises a step of pre-treating the metallic article by a pre-anodizing treatment before the step of anodizing the metallic article.

14. The method for anodizing and dyeing a metallic article of claim 13, wherein the pre-anodizing treatment comprises a polishing, texturing, degreasing, alkaline etching, or desmutting.

15. The method for anodizing and dyeing a metallic article of claim 11, wherein the method further comprises a step of sealing the metallic article by a second sealing treatment after the step of coloring the metallic article to seal the plurality of holes after the metallic article has been dyed.

16. The method for anodizing and dyeing a metallic article of claim 11, wherein the metallic article is made of aluminum, aluminum alloy, magnesium, magnesium alloy, titanium, or titanium alloy.

17. The method for anodizing and dyeing a metallic article of claim 11, wherein the first sealing solution comprises nickel acetate, nickel sulfate, or cobalt sulfate.

18. The method for anodizing and dyeing a metallic article of claim 11, wherein the anodizing treatment comprises a direct current anodizing treatment, an alternating current anodizing treatment, or a pulse current anodizing treatment.

* * * * *